United States Patent [19]

Phillips

[11] 4,026,099

[45] May 31, 1977

[54] DIFFERENTIALLY DRAFTED LOFTED MULTI-COMPONENT CONTINUOUS FILAMENT YARN AND PROCESS FOR MAKING SAME

[75] Inventor: Bobby M. Phillips, Kingsport, Tenn.

[73] Assignee: Eastman Kodak Company, Rochester, N.Y.

[22] Filed: July 29, 1976

[21] Appl. No.: 709,682

Related U.S. Application Data

[63] Continuation-in-part of Ser. No. 616,745, Sept. 25, 1975, abandoned.

[52] U.S. Cl. ..... 57/160; 28/72.12; 57/157 F; 57/157 S

[51] Int. Cl.[2] ..... D02G 1/16

[58] Field of Search ..... 57/34 B, 160, 157 F, 57/157 S, 157 MS; 28/1.4, 72.12

[56] References Cited

UNITED STATES PATENTS

| | | | |
|---|---|---|---|
| 2,924,868 | 2/1960 | Dyer | 57/34 B X |
| 3,303,169 | 2/1967 | Pitzl | 57/157 F |
| 3,453,709 | 7/1969 | Dyer | 57/34 B X |
| 3,473,315 | 10/1969 | LeNoir | 57/157 F X |
| 3,534,453 | 10/1970 | Lefebore | 28/72.12 |
| 3,898,719 | 8/1975 | Lloyd | 28/72.12 X |

*Primary Examiner*—Richard C. Queisser
*Assistant Examiner*—Charles Gorenstein
*Attorney, Agent, or Firm*—D. B. Reece, III; Malcolm G. Dunn

[57] ABSTRACT

Process and product obtained by the process by which an undrawn or partially drawn continuous filament yarn serving as an effect yarn component and a continuous filament yarn having a greater orientation than the effect yarn component and serving as a core yarn component are heated above glass transition temperature by co-current and counter-current heated gaseous flows to form in the filaments of the effect yarn component at random intervals along the lengths of the individual filaments coils, loops or whorls, with more drafting occurring in those portions of the filaments having the coils, loops or whorls than the other portions, and with more drafting occurring in some loops than others; intermingling the effect yarn component with the core yarn component, and at the same time heat setting the yarn components within the heated gaseous flows.

6 Claims, 2 Drawing Figures

DIFFERENTIALLY DRAFTED LOFTED MULTI-COMPONENT CONTINUOUS FILAMENT YARN AND PROCESS FOR MAKING SAME

BACKGROUND OF THE INVENTION

This invention is directed to a draw-lofting process for manmade yarns and particularly to polyester multi-component continuous filament yarns and fabrics including such yarns.

Previous lofted yarn products have been made using fully processed continuous filament yarns which are overfed to a high-pressure air jet device. Those products can be made with a single-end overfeed or with dual-end feed. In the case of polyester yarn, for instance, drafting may have been accomplished either on a draw-twister or on a continuous spin draw type apparatus.

U.S. Pat. No. 2,852,906 to Breen, for example, is representative of the prior art by which a bulky continuous filament yarn is achieved by passing a bundle of continuous filaments through a high velocity air jet in which the individual filaments are caused to become separated and whipped about sufficiently to form coils, loops or whorls at random intervals along their lengths. The various irregularly spaced convolutions in the yarn provide a lateral interfilament spacing important in producing the bulk and resulting garment warmth of fabrics made from such yarn.

As explained in an earlier Breen patent, U.S. Pat. No. 2,783,609, the "loops" indicated refers to tiny complete loops formed by a filament doubling back upon itself, crossing itself and then proceeding in substantially the original direction. In mathematics, a curve of this type is said to have a crunode; thus the term "crunodal loops" was derived by the patentee to distinguish in his specification those loops from other forms of loops. The patentee explained that the majority of loops visible on the surface of the yarn of his invention were of a roughly circular or ring-like shape. The crunodal loops inside of the yarn were not readily studied but that it was evident that the pressure of surrounding filaments would tend to cause such loops to assume more complex shapes. Breen reported that the most obvious characteristics of his continuous filament yarn were its bulkiness and the presence of a multitude of filament ring-like loops irreglarly spaced along its surface.

The Breen patents explain that a stream of air or other compressible fluid is jetted rapidly from a confined space to form a turbulent region in which yarn passing therethrouh is supported by the fluid stream and the individual filaments are separated from each other and whipped about violently in the turbulent region. As the separated filaments are removed from the turbulent region, they are swirled into convolutions which may be held in place by adjacent filaments of the reforming yarn bundle. The resulting bulkiness of the yarn may be stabilized by an additional treatment such as by twisting the filaments together, thereby increasing the friction between filaments to hold the convolutions more firmly in place. The yarn may then be would up for subsequent processing.

As shown by the numerous examples in the Breen patents, and as explained on page 549 in the text, "Man-Made Fibers" (4th Edition — 1963) by R. W. Moncrieff, Publisher: Heywood & Company Limited in London, England, the yarn is fed through an air jet to take-up rollers which draw off the yarn at a speed lower than the speed at which it is fed to the jet. Since the take-up speed is slower than the feed speed, the air-jet forms numerous randomly spaced loops, thereby taking up the slack in the filaments produced by the overfeed. As also explained in the test, the process does not depend on the thermoplasticity of the fiber and thus can be applied to any continuous multi-filament yarn, such as viscose rayon. The Breen patents also give as examples nylon (polyhexamethylene adipamide), glass, polyethylene terephthalate, cellulose acetate, acrylic and vinyl chloride-acrylonitrile copolymer yarns.

In still another Breen patent, U.S. Pat. No. 2,869,967, it is pointed out that the amount of "overfeed", which characterizes the difference between yarn feed and yarn take-up or wind-up, is one of the factors that controls the amount of bulking action accomplished in the air jet and should generally be in the range of 5 to 50 percent, depending upon the effect desired.

The discussion of the prior art thus far has been directed to single component yarns being treated in an air jet. In Example 4 of the above-mentioned Breen patent, U.S. Pat. No. 2,783,609, there is also disclosed two yarn components being unwound from separate spools, fed together to an air jet at 21 yards per minute, blended or plied together in the air jet and subsequently being rewound at 18 yards per minute. The patentee reported that more than one kind of filament could be processed simultaneously to create yarns with a desirable blend of fiber characteristics. A single type of fiber could also be used with yarn being fed simultaneously from more than one source of supply so that larger yarns could be built up. In these blends of different fibers or plies of the same fiber, the separate yarns are fed at the same speed to an air jet.

The above-described yarn combining operation differs from that involving a core yarn and an effect yarn where the effect yarn is fed to an air jet at a greater speed than the core yarn, or otherwise is said to be overfed to the jet as compared to the core yarn, resulting in an intermingled yarn in which the overfed component forms slub effects along the length of the yarn. The "slubs" constitute thickened places along the length of the yarn as compared to the other portions of the intermingled yarn. The effect yarn and the core yarn, as intermingled, are removed together from the air jet at the same speed. The overfeed of the effect yarn results in there being less tension on the effect yarn in the air jet than the tension on the core yarn so as to enable the looser tensioned yarn to form loops, convolutions and other protuberances around and along the length of the tighter tensioned core yarn.

The above-described operations are to be contrasted with the process disclosed in this invention wherein two yarns are preferably fed together at the same speed to a gaseous jet device and the previous respective, different orientations of the two yarns determines which yarn becomes the core yarn component and the other the effect yarn component. The process is further distinguished from the prior art in that the gases within the jet device are heated so as to raise the temperature of the yarns above the glass transition temperature and with the induced drag forces cause a drafting of one or the other yarn components or both yarn components to occur, with greater drafting taking place in the lesser oriented yarn component, and with differential or non-uniformed drafting occurring along the lengths of the individual filaments, thereby resulting in the formation at random intervals of coils, loops or whorls. The coils, loops or whorls in each filament are held in place by similar formations in adjacent filaments when the two intermingled yarn components leave the gaseous jet device as a single, unified yarn bundle, which has also been stabilized by having been heat set while within the gaseous jet device.

SUMMARY OF THE INVENTION

An object of this invention, therefore, is to provide a process for producing a multi-component, differentially drawn, lofted yarn. The process involves feeding from a source of supply to and through a gaseous jet device having co-current and counter-current gaseous flows an end of undrawn or partially drawn continuous filament yarn to serve as an effect yarn component, and feeding from a source of supply to and through the gaseous jet device an end of continuous filament yarn to serve as a core yarn component and having a greater orientation than the effect yarn component. The two yarn components are heated to a predetermined temperature above the glass transition temperature by the co-current and counter-current gaseous flows while in the gaseous jet device. The effect yarn component is differentially drafted in the jet device by drag forces induced by the heated co-current and counter-current gaseous flows to form in the filaments at random intervals along the lengths of the individual filaments coils, loops or whorls in those portions of the effect yarn that are drafted more than the other portions. The effect yarn component is intermingled with the core yarn component and both components are heat set while in the gaseous jet device. The intermingled yarn components are then taken up at speeds and tensions insufficient to remove the loops. Those portions of the effect yarn component having the coils, loops or whorls are drafted more than the other portions, with more drafting occurring in some loops than others. The loops also include crunodal loops as described above.

Drafting occurs in the jet because once the yarn has been raised to a temperature above its glass transition temperature, the tensions on the yarn caused by the high speed turbulent stream are sufficient to induce elongations in the yarn. It is thought that the differential drafting occurs because of the variability in induced tension across the flow channel. In plotting a velocity profile across the flow channel of the gaseous jet device, the maximum or greatest drag inducing force will occur at the center of the velocity profile, i.e., at the center of the flow channel, while the least drag inducing force will occur at the interior wall surface of the flow channel. In the turbulence which occurs within the jet device, the filaments of the yarn strand or bundle will become separated from each other and will be whipped violently about. Those filaments within the center of the flow channel of the jet device will tend to have the greatest induced drag forces imposed thereon with a resulting greater loop or coil or whorl being formed. Those filaments near the interior wall surface will tend to have the least drag forces imposed thereon with a resulting smaller loop or coil or whorl being formed. The filaments, however, will not stay solely within the center or solely next to the wall, so that the overall combination of drag forces including collisions with other filaments or looping portions of filaments will bring about the final end result, which is a nonuniform drafting or differential drafting of the filaments and of the loops in the filaments.

The process may also involve feeding to the gaseous jet device a core yarn component which may be fully drafted (fully oriented) while the effect yarn component that is fed to the gaseous jet device may be undrawn or partially drawn (partially oriented).

The process may also involve feeding to the gaseous jet device a core yarn component which may be partially drafted (partially oriented) while the effect yarn component that is fed to the gaseous jet device may be undrawn and thus has a lesser orientation than the core yarn component. The partially drafted core yarn component will in turn become differentially drafted within the gaseous jet device.

Another object of this invention is to provide a multi-component continuous filament yarn product having a core yarn component and an effect yarn component intemingled with the core yarn component. The effect yarn component has at random intervals along the lengths of the individual filaments coils, loops or whorls and is characterized by the filaments being differentially drafted with the portions of the filaments containing the coils, loops or whorls being more drafted than the other portions of the filaments. It is further characterized by more drafting occurring in some loops of the effect yarn component than others.

The multi-component filament yarn product may also have a core yarn component which has at random intervals along the lengths of the individual filaments coils, loops or whorls and is characterized by the filaments being differentially drafted with the portions of the filaments containing the coils, loops or whorls being more drafted than the other portions of the filaments. It is further characterized by more drafting occurring in some loops of the core yarn component than others. It is still further characterized by greater differential drafting occurring in the effect yarn component than in the core yarn component.

Still another object of the invention is to provide a fabric which includes as components of the fabric multi-component continuous filament yarns having filaments with differentially drafted coils, loops or whorls formed at random intervals along the lengths of individual filaments of the yarns. The fabric may be woven or non-woven, or may be knitted, and may include other types of yarn or fiber components.

A further object of this invention is to provide a yarn product which may contain from about 15 to 85 percent disperse dyeable filaments and from about 85 to 15 percent basic dyeable filaments. The load bearing yarn component, which is the component containing the greater drafting or orientation, can be either the disperse dyeable component or the basic dyeable component. The yarn component which drafts in the heated gaseous jet device and forms a loopy structure along the length of its individual filaments can also be either the disperse dyeable yarn component or the basic dyeable yarn component. The resulting product may be a bulky continuous filament yarn with desirable tactile aesthetics and a desirable heather effect upon dyeing.

The co-current and counter-current gaseous flows, preferably air flows, are heated to temperatures greater than glass transition temperature, and the speed of the co-current and counter current air flows is preferably greater than 50% of sonic velocity. The co-current and counter-current flows may range from essentially 0–100 percent co-current and 100–0 percent counter-current with the sum total of the two flows being 100 percent. The preferred flows are essentially 75 percent co-current and 25 percent counter-current. It should be recognized, however, that the take-up speed of the yarn is dependent upon the temperature of the gaseous flow and its velocity so as to achieve heating of the yarn above glass transition temperature.

One of the advantages of this yarn product over lofted yarn of the blended type produced from the practice of the Breen disclosure is that boiling water shrinkage will be about zero percent since the yarn has dimensionally stabilized by crystallization due to being heat set at a temperature above the boiling point of water in an essentially relaxed condition. On the other hand, the boiling water shrinkage for the prior art lofted blended yarn is generally about 5 to 7 percent.

Another advantage, as to a yarn product made from thermoplastic materials such as from polyester, is that "picking" propensity in a fabric containing the yarn product of this invention will be reduced. The reason for this is thought to be that the process tends to weaken the yarn and allow it to break more readily, whereas in a fabric made from the lofted yarn of the type shown in the Breen disclosures made from fully oriented yarn, a picked filament can cause distortion of a large section of the fabric before the filament finally breaks.

One of the problems presented by use of polyester continuous filament yarn, or use of any other high break resistant thermoplastic yarn, for that matter, in conventional air lofting processes of the prior art has to do with the difficulty resulting from the attempt to withdraw the yarn from a package on which the yarn has been wound. The coils, loops or whorls protruding from the surface of one yarn strand tend to become interlocked with those of the contiguous yarn strands. Since polyester continuous filament yarn, for instance, is so much stronger than cellulose acetate continuous filament yarn, the filaments of one polyester yarn strand so interlocked will, upon attempt to withdraw from the yarn package, pick and pull out other filaments from the centiguous yarn strands and thereby tend to destroy the integrity of the yarn strands and make uniform withdrawal difficult. This situation is also true of a fabric made from polyester continuous filament lofted yarn when the fabric is doubled or folded against itself and then attempt is made to unfold it. This problem does not arise with cellulose acetate continuous filament conventional lofted yarn since the weaker cellulose acetate filaments will break more readily and will not pick or become tenaciously adhered to the filaments in the contiguous yarn strands.

Still another advantage, therefore, of a yarn product made from thermoplastic materials, such as polyester, in the practice of the disclosed process is that the differential drafting obtained will tend to weaken the loopy portions of the yarn and cause them to break more readily when attempt is made to separate one yarn strand from another, or to separate one part of a fabric containing this yarn from another part of the fabric or from another fabric.

One of the advantages of the process of this invention is that it is more economical to practice the process since drafting and heat setting of the yarn product occur in a single step or within a single device. Unlike the Breen patented disclosures in which the yarn was drafted and oriented before passing the yarn through the lofting jet, such prior drafting is not necessary as in the instance of using an undrafted yarn, and it is also not necessary to steam the yarn after the lofting step in order to impart a permanent set, as proposed, for example, by Breen in U.S. Pat. No. 2,783,609.

Another advantage of the process of this invention over the lofting processes disclosed in the prior art such as represented by the Breen patents is that it has the potential for greater speed through the gaseous jet device since the speed of the prior art processes is limited by the turbulence conditions and the slack conditions in the turbulence zone within the jet device. The process of this invention is only limited by the residence time and the heat transfer conditions within the jet sufficient to raise the yarn to above the glass transition temperature in order to enable the induced drag forces to differentially draft the yarn.

Other advantages will be apparent to those skilled in the art to which this invention pertains.

PREFERRED EMBODIMENT OF THE INVENTION

Figure 1:
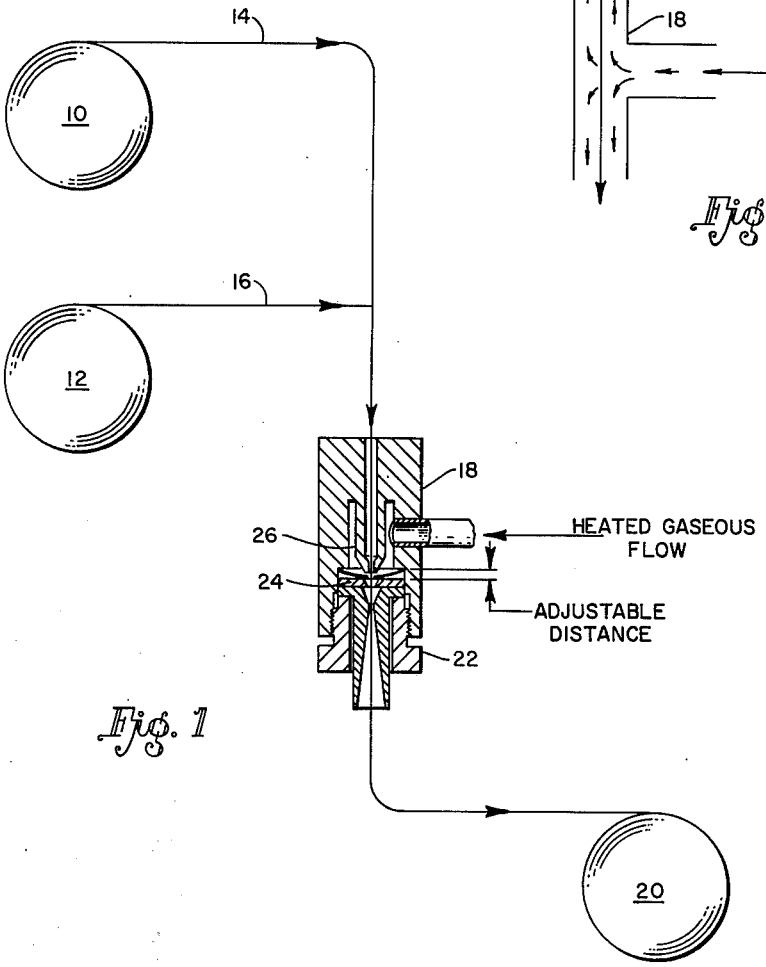
FIG. 1 is a simple schematic illustration of mult-component continuous filament yarn sources, typical gaseous jet device and a yarn take-up device.

In reference to FIG. 1 of the drawings, 10, 12 designate sources of supply of ends of continuous filament multi-filament yarns or yarn components, 14, 16. One of the yarn components may be undrawn, or partially drawn or otherwise termed a "partially oriented yarn". The other yarn component may be fully drawn (fully oriented) or partially drawn (partially oriented), and its orientation will be greater than that of the other yarn component.

Figure 2:
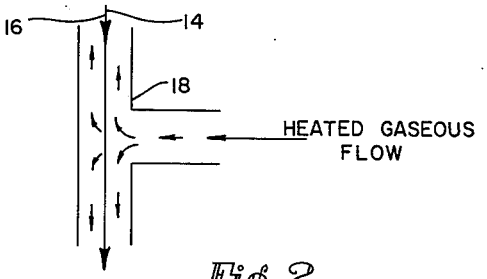
FIG. 2 is a diagrammatic illustration of the co-current and counter-current gaseous flows within the gaseous jet device.

The reference number 18 designates a conventional yarn lofting device constructed similarly to that disclosed in the Dyer patent, U.S. Pat. No. 2,924,868, which is preferably T-shaped, although not necessarily limited to T-shaped, so that the yarn passes to and through the jet device along one generally straight-line path while a source of heated air or other suitable heated gas intersects the yarn at essentially right angles to flow both co-current and counter-current to the direction of the yarn travel, as shown in FIG. 2.

As will be recognized by those skilled in the art, the conventional lofting or jet device 18 may be adjusted by means of the threaded plug 22 to determine the desired percentage of co-current and counter-current air flows. The movement of the threaded plug toward or away from the orifice plate 24 causes the distance between the nozzle or nozzle tip 26 and the orifice plate 24 to be varied or adjusted. For instance, the following table illustrates the consequence of a few of such adjustments.

TABLE

| *Counter-Current | % Co-Current | Distance Between Nozzle and Orifice Plate |
|---|---|---|
| 0 p.s.i.g. | 100% | .051 inch |
| 4 p.s.i.g. | about 80% | .055 inch |
| 8 p.s.i.g. | about 60% | .059 inch |
| 12 p.s.i.g. | about 40% | .076 inch |

*From a system having a maximum air pressure of 20 p.s.i.g.

The invention is not limited to the use of the particular jet device shown in the drawing or in the Dyer patent since obviously other jet device constructions may be used. The Dyer jet device as illustrated, however, may be inverted so that the yarn enters what was previously the yarn outlet end, as shown in order to contain a 0 percent co-current flow and a 100 percent counter-current flow. The nozzle opening may also be enlarged. All of this discussion is only to establish that the jet device per se is not the invention, but rather the overall concept of how applicant's invention is accomplished. The co-current and counter-current heated gaseous flows or heated air flows set up a turbulent region in which the individual filaments of the yarn are raised to above the glass transition temperature and are caused to become separated and whipped about in the jet. The individual filaments of the undrawn or partially drawn yarns are caused to become locally drafted as they are being whipped about, with the consequence that coils, loops or whorls are formed at random intervals along the lengths of the individual filaments. The yarn take-up device is shown simply at 20, which may be any conventional yarn wind-up apparatus.

The heated co-current and counter-current air flows induce drag forces on the continuous filament yarn passing through the jet device to cause the differential drafting. At the same time, the heated air flows serve to heat set the yarn.

The process involves the use of an undrawn or partially drawn (partially oriented) feeder effect yarn component and a fully drawn or partially drawn feeder core yarn component, such as of polyester yarn from poly(ethylene terephthalate) polymer, which are fed to a jet device in which the heated gaseous flows, such as air, heat the feeder yarn components to above the glass transition temperature of the particular yarn components concerned. With respect to polyester yarn from poly(ethylene terephthalate) polymer, it is preferred that the temperature should be above 80° C., which is slightly above its glass transition temperature.

The amount of drafting and lofting which takes place is determined by the design of the jet itself, velocity, pressures and temperature of the air in the jet and the yarn velocity through the jet, and the extent to which the yarn may have been previously drafted. The range of air pressures extends from about 30 p.s.i.g. to about 500 p.s.i.g.; the range of air temperature may extend from slightly above the glass transition of a particular material up to about 250° C., the temperature being limited by the material of the jet device; the range of heat setting temperatures may extend from about 130° C. up to about 250° C.; and the take-up speed of the yarn from the gaseous jet device may extend up to around 1000 meters per minute. The heat setting temperature depends upon the temperature necessary to bring about dimensional stabilization of the desired material by crystallization.

The particular speeds, temperatures, residence time in the jet device and the like are dependent, of course, on whatever is necessary to raise a particular material above its glass transition temperature. If it should also be desired that the yarn be heat set while in the jet device, then the temperatures, speeds employed, and the like must be such as to stabilize the yarn, particularly if it is desired that the product have a boiling water shrinkage of about zero percent.

The invention is applicable to any thermoplastic yarn capable of being drafted in heated gaseous flow of air flows. Other compressible fluids or gases may be employed as desired.

The yarn product, preferably, may contain from about 15 to 85 percent disperse dyeable filaments and from about 85 to 15 percent basic dyeable filaments. The load bearing yarn component (the component containing the most drafting or orientation) can be either the disperse dyeable component or the basic dyeable component. The component which drafts in the heated jet and forms the loopy structure can also be either the disperse dyeable component or the basic dyeable component. Thus, the product may be a bulky continuous filament yarn with desirable tactile aesthetics and a desirable heater effect upon dyeing.

This invention can be further illustrated by the following examples of preferred embodiments thereof, although it will be understood that these examples are included merely for purposes of illustration and are not intended to limit the scope of the invention unless oherwise specifically indicated.

EXAMPLE 1

The component yarns were 150 denier/30 filaments fully drawn disperse dyeable poly(ethylene terephthalate) filament yarn and 525 denier/125 filaments undrawn basic dyeable poly(ethylene terephthalate). These yarns were passed through a lofting jet at 58 ft./min. with 30 psi. air, at a temperature of 175° C. The intermingled yarn produced was very bulky and exhibited desirable heater effects on dyeing with a variety of basic and disperse dyes. The physical properties of the bulky yarn were:

Denier — 798
Tenacity — 1.0 g./den.
Modulus — 12. g./den.
Elongation — 45 percent
Boiling water shrinkage — 0 percent
Specific Volume — 3.52 cubic centimeters/gram at a tension of 0.1 gram/denier For this example, the loops were of the basic dyeable a polymer.

EXAMPLE 2

The component yarns were fully drawn 150 denier/30 filaments basic dyeable poly(ethylene terephthalate) and 250 denier/30 filaments disperse dyeable poly(ethylene terephthalate) partially oriented or partially drafted yarn. These yarns were passed through a lofting jet at 58 ft./min. with 30 psi. air, at a temperature of 175° C. The intermingled yarn was very bulky and exhibited desirable heather effects on dyeing with a variety of basic and disperse dyes. The physical properties of the bulky yarn were:

Denier — 449
Tenacity — 1.6 g./den.
Elongation — 40 percent
Modulus — 18 g./den.
Boiling water shrinkage — 0 percent
Specific volume — 3.1 cubic centimeters/gram at a tension of 0.1 gram/denier The specific volume given in the examples above is a bulk yarn test which is conducted in the following manner:

An aluminum cylinder, which has a diameter of 3 inches, has an annular groove machined within its surface around the circumference of the cylinder. The slot is ⅛ inch wide and ½ inch deep. The volume of the annular groove equals 8.044 cubic centimeters. The yarn to be tested is wound under a specified tension of 0.1 gram per denier within the annular groove until the yarn fills the annular groove and is level with respect to the surfaces of the cylinder adjacent groove and weighed in grams. The specific volume in cubic centimeters per gram is equal to the volume of the annular groove in the cylinder or 8.044 cubic centimeters divided by the weight in grams of the yarn removed from the cylinder.

Non-textured, round cross-sectioned, fully drafted poly(ethylene terephahalate) filament yarn generally has a specific volume of about 1.00 cubic centimeters per gram by this bulk test.

In this example, the loops were of the disperse dyeable polymer.

The invention has been described in detail with particular reference to preferred embodiments thereof, but it will be understood that variations and modifications can be effected within the spirit and scope of the invention.

I claim:

1. Process for producing multi-component drawlofted yarn, the process comprising feeding from a source of supply to and through a gaseous jet device having co-current and counter-current gaseous flows an end of undrawn or partially drawn continuous filament yarn to serve as an effect yarn component, feeding from a source of supply to and through the gaseous jet device an end of continuous filament yarn to serve as a core yarn component and having a greater orientation than the effect yarn component, heating the effect yarn and the core yarn components while in the jet device to a predetermined temperature above the glass transition temperature by the co-current and counter-current gaseous flows, differentially drafting the effect yarn component in the jet device by drag forces induced by the heated co-current and counter-current gaseous flows and thereby form in the filaments at random intervals along the lengths of the individual filaments coils, loops or whorls in those portions of the efect yarn component that are drafted more than the other portions so differentially drafted and intermingling the effect yarn component with the core yarn component, the co-current and counter-current gaseous flows ranging from essentially 0–100 percent of total flow co-current and 100–0 percent of total flow counter-current with the sum total of the two flows being 100 percent, and taking up the intermingled yarn components from the gaseous jet device at speeds and tensions insufficient to remove the loops.

2. Process as defined in claim 1, and further comprising heat setting the yarn in the gaseous jet device.

3. Process as defined in claim 1, wherein the effect and core yarn components are poly(ethylene terephthalate) and are heated in the gaseous jet device to temperatures greater than 80° C.

4. Process as defined in claim 3, wherein the speed of the co-current and counter-current gaseous flows in the gaseous jet device is greater than 50 percent of sonic velocity.

5. Process as defined in claim 1, wherein a fully oriented yarn is fed to and through the gaseous jet device as the core yarn component.

6. Process as defined in claim 1, wherein a partially oriented yarn is fed to and through the gaseous jet device as the core yarn component and is differentially drafted in the jet device to form in the filaments along the lengths of the individual filaments coils, loops or whorls in those portions of the yarn that are drafted more than the other portions so differentially drafted and intermingled with the effect yarn component.

* * * * *